US009599081B2

(12) United States Patent
Dorn et al.

(10) Patent No.: US 9,599,081 B2
(45) Date of Patent: Mar. 21, 2017

(54) TAPPET

(71) Applicant: Schaeffler Technologies GmbH & Co. KG, Herzogenaurach (DE)

(72) Inventors: Stefan Dorn, Hollfeld (DE); Norbert Geyer, Hochstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/408,113

(22) PCT Filed: Apr. 15, 2013

(86) PCT No.: PCT/EP2013/057820
§ 371 (c)(1),
(2) Date: Dec. 15, 2014

(87) PCT Pub. No.: WO2013/189623
PCT Pub. Date: Dec. 27, 2013

(65) Prior Publication Data

US 2015/0192098 A1 Jul. 9, 2015

(30) Foreign Application Priority Data

Jun. 18, 2012 (DE) ..... 10 2012 210 176

(51) Int. Cl.
*F01L 1/14* (2006.01)
*F02M 59/10* (2006.01)
*F04B 1/04* (2006.01)

(52) U.S. Cl.
CPC ..... *F02M 59/102* (2013.01); *F01L 1/146* (2013.01); *F04B 1/0408* (2013.01);
(Continued)

(58) Field of Classification Search
CPC ..... F01L 1/143
(Continued)

(56) References Cited

U.S. PATENT DOCUMENTS 5,327,860 A * 7/1994 Kruger ..... F01L 1/25 123/90.48
2008/0190237 A1* 8/2008 Radinger ..... F01L 1/143 74/569

FOREIGN PATENT DOCUMENTS

CN 103423119 12/2013
DE 102010022318 12/2011
(Continued)

*Primary Examiner* — Jorge Leon, Jr.
(74) *Attorney, Agent, or Firm* — Volpe and Koenig, P.C.

(57) ABSTRACT

A tappet (1) for a fuel injection pump, having a tube-like housing (2), which accommodates a roller (4) for the running on a periodic lift generator inside the inner lateral surface (5) thereof in the region of a first ring end (3). This roller has axle stumps (7) projecting from the end faces (6) of the roller, by which stumps the roller sits in recesses (8) in the housing (2), wherein the housing (2) is penetrated axially by a bridge piece (9) underneath the roller (4), the underside (11) of which bridge piece, which faces a second ring end (10) of the housing (2), acts as a rest for a plunger following part. The inner lateral surface (5) of the housing (2), proceeding from the first ring end thereof in the direction of the second ring end (3, 10) and at least in the circumferential section (13) thereof, which surrounds an outer lateral surface (12) of the roller (4), has a pocket-like thinned portion of material (14), which levels out under a half of the height of the roller (4) and into which the ring edges (15) of the roller (4) project.

7 Claims, 1 Drawing Sheet

(52) U.S. Cl.
CPC ..... *F04B 1/0426* (2013.01); *F01L 2101/00* (2013.01); *F01L 2103/00* (2013.01); *F01L 2105/00* (2013.01); *F02M 2200/03* (2013.01)

(58) Field of Classification Search
USPC ..... 123/90.48
See application file for complete search history.

(56) References Cited

FOREIGN PATENT DOCUMENTS

| | | |
|---|---|---|
| DE | 201010026362 | 1/2012 |
| DE | 102011085243 | 5/2013 |
| EP | 0615056 | 9/1994 |

* cited by examiner

TAPPET

BACKGROUND

The invention relates to a tappet, in particular, for a pump or a compressor, with a tube-like housing that holds, in the area of a first annular end face, a roller for a run-in of a periodic lift generator within its inner lateral surface, wherein this roller has axle ends with one or more parts that project from the end sides of the roller and by means of which the roller is seated in receptacles of the housing, wherein a bridge piece passes through the housing axially below the roller, with the lower side of this bridge piece facing a second annular end face of the housing acting at least indirectly as a contact surface for a tappet follower.

Such a tappet is disclosed in DE 10 2010 022 318 A1. It is used in a highly stressed fuel injection pump of a quality- or quantity-controlled internal combustion engine.

Increasing load bearing requirements on tappets caused, e.g., by increases in rotational speed and injection pressure, require more robust designs that, however, come up against limits on installation space. Thus it happens that a comparatively small roller is installed with only a limited bearing capacity. By increasing the roller radius, this would, stated simply, make its two annular edges contact the inner lateral surface of the housing. By increasing a radius of the tappet for housing the larger roller, its pump-side guide would necessarily have to be increased, which would result in considerable changes to already produced pump designs.

SUMMARY

The objective of the invention is to create a tappet that can be loaded more strongly and that has compact dimensions.

According to this invention, this goal is attained in that the inner lateral surface of the housing has, starting from its first annular end face in the direction toward the second annular end face, as well as at least in its circumferential section enclosing an outer lateral surface of the roller, a pocket-like reduction in material tapering slightly below half a height of the roller, with the roller projecting into or onto this reduction in material with its annular edges.

In this way, a highly stressed tappet is provided that has a compact construction like before and its weight is, at a maximum, only slightly increased relative to the previously known tappet due to the now larger roller. Thus it is possible to use larger rollers that thus can carry higher loads with better load ratings for the cam or eccentric run-in without increasing the diameter of the housing or without significantly weakening its walls.

Compared with the prior art cited above, the area of the inner lateral surface of the housing with thinner walls is in the upper section, ultimately turned upside down relative to the previously known design.

The roller preferably sits inside the upper edge of the housing as much as possible, which contributes to a compact construction. If necessary, its receptacles can also be formed on projections extending upward from the first annular end face. The receptacles can be holes or U-like pockets that are open to the top.

Indeed, it is generally conceivable and provided to remove the material of the inner lateral surface only in the circumferential area that lies opposite an outer lateral surface of the roller, so that a remaining inner lateral surface section ultimately forms, together with the lower inner lateral surface section, a smooth wall. In terms of production, however, it is preferable for the material removal to be a circumferential ring, so that the housing can be simply deep drawn or extruded. As an alternative to the latter measures, a cutting process or an MIM representation are also possible.

Due to the material thinning proposed as a circumferential ring, the housing at the inner lateral surface has only a two-step construction and thus a simple shape. The outer lateral surface of the housing has a smooth wall with no steps as much as possible according to the proposal, so that a good guidance length for this is produced in the receptacle. If necessary, the inner lateral surface could also have more than two steps.

According to another refinement of the invention, the axle ends that carry the roller in the housing are connected either with one or more parts to the roller. For the multiple-part, preferred solution, the axle ends are thus part of a pin on which the roller can rotate, e.g., by means of a needle bearing. In the multiple-part variant, the axle ends would thus rotate relative to their housing-side receptacles, wherein, if necessary, also needle bearings could be used.

BRIEF DESCRIPTION OF THE DRAWINGS

The tappet according to the proposal must be used in or for a fuel injection pump of a quality- or quantity-controlled internal combustion engine. In the same way, use in a valve train of an internal combustion engine or in an axial or radial piston compressor or a corresponding pump is possible.

The invention follows from the drawing.

DETAILED DESCRIPTION OF THE PREFERRED EMBODIMENTS

Figure 1:
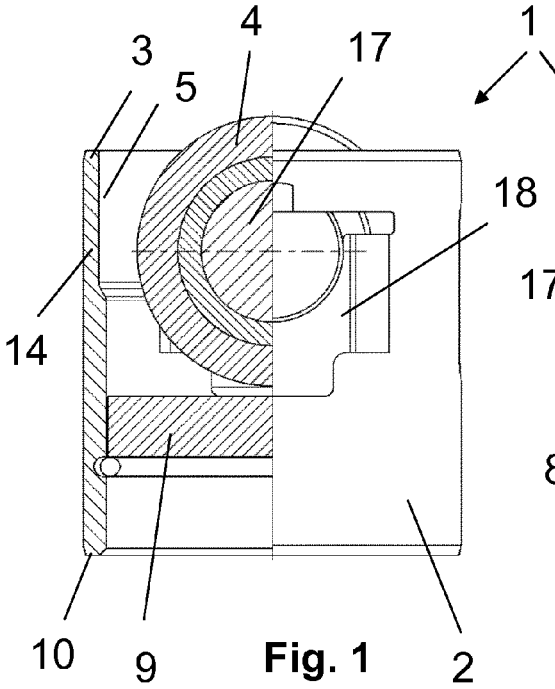
FIG. 1 shows a longitudinal section of the tappet.
Figure 2:
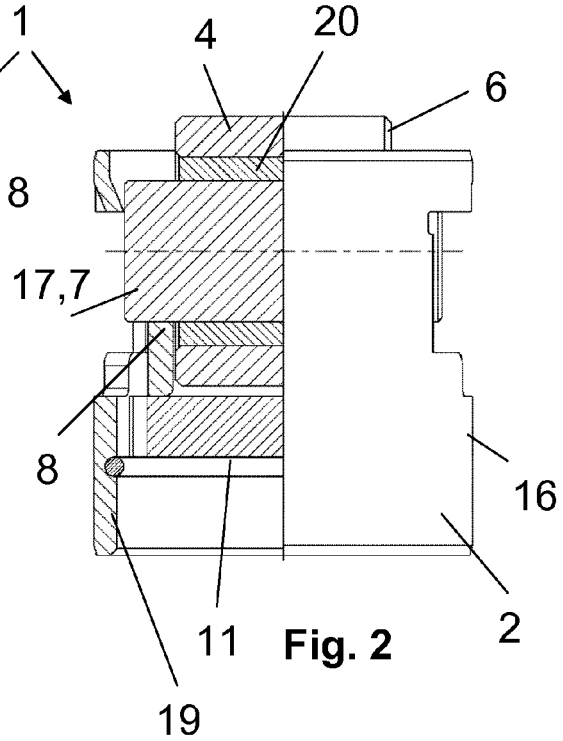
FIG. 2 shows a longitudinal section rotated by 90° relative to FIG. 1.

Shown is a tappet 1, here for a high-pressure pump for diesel fuel of an internal combustion engine. The tappet 1 has a tube-like housing 2 that holds, in the area of a first, upper annular end face 3, a roller 4 for a run-in of a reciprocating cam within its inner lateral surface 5.

A separate bridge piece 9 axially underneath the roller 4 passes through the housing 2 that is deep drawn from a steel sheet. This bridge piece is provided as a stamped plate, whose bottom side 11 facing a second, lower annular end face 10 of the housing 2 acts as a contact surface for a pump piston.

As shown, the roller 4 runs by means of an anti-friction bearing 20 on a pin 17. The latter is held on each end, here called axle end 7, in a semi-cylindrical receptacle 8 of an indented area 18 of the housing 2 formed as a flat section.

Figure 3:
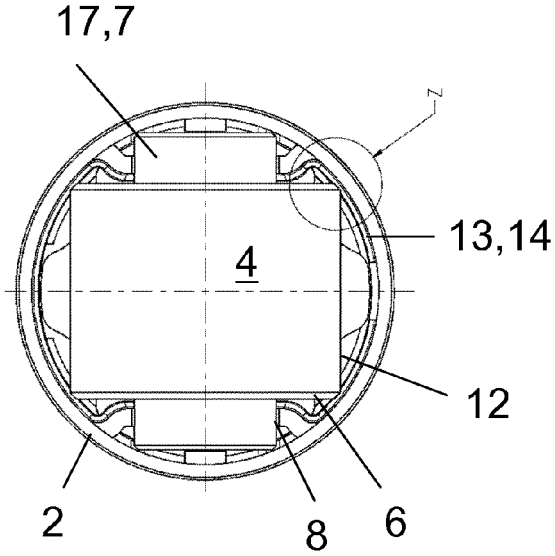
FIG. 3 shows a top view of the tappet.
Figure 4:
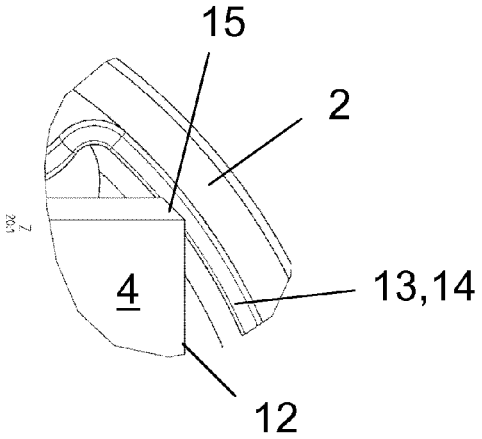
FIG. 4 shows the detail "Z" according to FIG. 3.

The inner lateral surface 5 of the housing 2 has a pocket-like reduction of material 14. This starts from its first annular end face in the direction toward the second annular end face 3, 10, so that the inner lateral surface 5 of the housing 2 describes, in its upper area, a larger circle than in the lower area. The reduction of material 14 ends below half the height of the roller 4. This simple measure makes it possible to install a larger roller 4 that thus can carry higher loads, without increasing the housing diameter itself. The roller 4 projects with its ring edges 15 into the area of the reduction of material 14 of the inner lateral surface 5, which is easy to see from FIG. 3 in connection with FIG. 4.

LIST OF REFERENCE NUMBERS

1) Tappet

2) Housing

3) First end face
4) Roller
5) Inner lateral surface
6) End side
7) Axle end
8) Receptacle
9) Bridge piece
10) Second end face
11) Bottom side
12) Outer lateral surface of roller
13) Circumferential section
14) Reduction of material
15) Ring edge
16) Outer lateral surface of housing
17) Pin
18) Area
19) Inner lateral surface ring
20) Anti-friction bearing

The invention claimed is:

1. A tappet comprising, a tube-shaped housing having first and second ends, a roller for a run-in of a periodic lift generator located in an area of the first end within an inner lateral surface thereof, said roller has axle ends with one or more parts that project from end sides of the roller and by which the roller is seated in receptacles of the housing, a bridge piece passes through the housing axially below the roller, a lower side of said bridge piece faces the second end of the housing acting at least indirectly as a contact surface for a tappet follower, the inner lateral surface of the housing has a first thickness at the first end and a second greater thickness at the second end, and, starting from the first end in a direction toward the second end, as well as at least in a circumferential section thereof enclosing an outer lateral surface of the roller, the first thickness forms a pocket-shaped reduction in material with a taper slightly below half a height of the roller that extends to the second thickness, with the roller projecting into or onto said reduction in material with its annular edges.

2. The tappet according to claim 1, wherein the pocket-shaped reduction in material is present as a circumferential ring.

3. The tappet according to claim 2, wherein the inner lateral surface of the housing has only two steps, including the reduction in material for the first end and a remaining inner lateral surface ring for the second end, and an outer lateral surface of the housing has a smooth wall with no steps.

4. The tappet according to claim 1, wherein the axle ends are either an integral part of the roller or provided as end pieces of a separate pin on which the roller runs as a sliding or rolling bearing.

5. The tappet according to claim 1, wherein the receptacles of the housing for the axle ends are present as holes or pockets open in a direction toward the first end, and each of the receptacle is located in an indented area of the housing formed as a flat section.

6. The tappet according to claim 1, wherein the reduction of material is formed without a cutting process in the housing.

7. The tappet according to claim 1, wherein the housing is an extruded or deep drawn housing formed without a cutting process.

* * * * *